United States Patent [19]

Azzerri et al.

[11] 4,178,194

[45] Dec. 11, 1979

[54] ELECTROLYTIC PICKLING OF SILICON ELECTRICAL STEEL SHEET

[76] Inventors: Nazzareno Azzerri, via Catullo No. 57, Pomezia (Roma); Roberto Bruno, via Cassia 1041, Roma, both of Italy

[21] Appl. No.: 970,109

[22] Filed: Dec. 18, 1978

[30] Foreign Application Priority Data

Dec. 16, 1977 [IT] Italy ..... 52249 A/77

[51] Int. Cl.[2] ..... H01F 1/04; B23P 1/00

[52] U.S. Cl. ..... 148/111; 148/113; 204/129.43

[58] Field of Search ..... 148/113, 111; 204/129.43, 129.4

[56] References Cited

U.S. PATENT DOCUMENTS

| | | | |
|---|---|---|---|
| 2,197,653 | 4/1940 | Wilson | 204/129.4 X |
| 2,374,449 | 4/1945 | Mulcahy | 204/129.43 |
| 2,820,003 | 1/1958 | Logan et al. | 204/129.43 |
| 3,905,885 | 9/1975 | Bengel et al. | 204/129.43 |
| 3,932,236 | 1/1976 | Wada et al. | 148/113 |

FOREIGN PATENT DOCUMENTS

| | | | |
|---|---|---|---|
| 2621108 | 11/1976 | Fed. Rep. of Germany | 204/129.43 |

*Primary Examiner*—John H. Mack
*Assistant Examiner*—D. R. Valentine
*Attorney, Agent, or Firm*—Young & Thompson

[57] ABSTRACT

The electrolytic pickling of silicon electrical steel sheet that follows hot rolling, is improved by limiting the potential imposed on the steel, during the anodic phase thereof, to less than +1 V with respect to the standard hydrogen electrode, preferably less than +0.8 V. The avoidance of electrolysis of the aqueous medium shortens the treatment time. reduces energy consumption, avoids over-pickling, facilitates subsequent rolling, reduces the subsequent rolling load, improves adherence of the subsequently applied glass film, and renders more uniform the magnetic characteristics of the steel.

5 Claims, No Drawings

ELECTROLYTIC PICKLING OF SILICON ELECTRICAL STEEL SHEET

The present invention relates to the production of silicon electrical steel sheet, and in particular to improvements in the production cycle immediately after hot-rolling so as to permit a lengthy storage of the hot rolled steel sheet without oxidation of the steel sheet, and also so as to permit an improvement in cold rolling. It also allows elimination of the acid pickling phase subsequent to hot rolling in a way which is advantageous and neither pollutive nor dangerous.

The usual process for production of silicon electrical steel sheet (hereinafter referred to as "electrical steels" for the sake of brevity) can be outlined as follows:

melting, deoxidation and alloying;
casting in slabs or ingots;
hot rolling;
intermediate heat treatment;
cold rolling;
final heat treatment and coating.

The hot-rolled strip, as is well known, is oxidized and covered with a scale, constituted by various oxide layers of substantial thickness that are more or less adherent.

The fine layers of oxides, and the scale, are eliminated before cold rolling because they would cause serious drawbacks during rolling and in the final product; these problems are well known, and need not be discussed further here.

The elimination of oxide coatings is usually effected by acid pickling; in certain cases this is preceded by a descaling and preliminary mechanical cleansing, as for example by shot-peening.

However, since electrical steel is extremely susceptible to oxidation, and since in its manufacturing process the lengthy stages are those of thermal treatment, it results almost as a matter of course that the coils of electrical steel which have been hot rolled and pickled must wait for a considerable time before they can be cold rolled.

During these "dead times" the pickled steel re-oxidizes, and a final pickling becomes necessary.

Even if it were possible to cold roll the sheet immediately after pickling, it is clear that any delay after the pickling, whatever might be the cause of it, would worsen the problem of oxidation of the hot rolled strip.

The solution previously proposed for this problem—to protect the hot-rolled strip by coating—is not only uneconomical because of the need to modify the lines for the purpose of adding insulative coatings, but also provides only a partial solution. In fact, since the insulation would have been eliminated before cold rolling, the problem again arises of oxidation during the inevitable delays in the cold rolling process. Hence it is evident that there is a great need for avoiding the oxidation of a strip of electrical steel, from the moment it emerges from pickling, to the moment when, after hot rolling, it is finally insulated with products which remain permanently on the strip, and—among other effects—impede its oxidation.

A first solution to this problem seemed to come as a side advantage from a known process for neutral electrolytic pickling of steels, e.g. as described in Italian application Ser. No. 50043 A/75.

According to this known process, a strip of steel is passed through a solution of sodium sulphate, of a concentration of 0.5 to 2.5 M, with a pH around neutral. The process is carried out by imposing current of a fixed current density at predetermined temperatures and times of treatment, so as to effect the electrolysis of the water. Since the strip is alternately connected as cathode and anode, hydrogen and oxygen are therefore given off, in that order, from the surface of the strip. This condition of electrolysis of the water is used, in the known process mentioned above, for the correct carrying out of the pickling. In this same process, it is also known that in cases where electrical steels are involved, the process described imparts a passivising protection to the surface of the steel.

Subsequent studies on the pickling of electrical steels have, however, shown that the conditions for stable protection are reached, during the application of the abovementioned method, only with long periods of treatment, and with a very high consumption of energy, i.e. in a way which makes the process economically unattractive. Moreover, these conditions impose a very high degree of over-pickling on the strip, with consequent losses in weight which cannot be accepted.

It has been discovered that during the anodic treatment of electrical steel, after an initial stage of stabilization of the potential of active dissolution, which is rather longer under comparable conditions than for carbon steels, there follows a stage of very rapid increase of working potential of the steel toward higher values, with the formation of highly passivating films, and subsequently the beginning of the electrolysis of the water. The latter slowly tends to become stabilized after a first phase marked by a progressive diminution in the potential, and by a change in the nature of the film. It is not entirely clear what happens during the very rapid intermediary phases, but it is in fact during these phases that the troubles appear which make the process described above unsatisfactory. During the phase of very rapid rise of potential, the passivating film assumes a greyish, rather unattractive appearance, and becomes enriched with silicate (probably in the form of fayalite), after which, in the first unstable stage of electrolysis the film again becomes modified, but not in a uniform manner. In this case, recovery of the homogeneity of the surface can only be achieved by prolonging the treatment excessively. To interrupt the treatment at this point means not only producing a sheet of spotted and nonuniform appearance, but also producing a surface covered with a passive layer which is not uniform either in thickness or in composition, which causes non-uniformity in the formation and in the adhesion of the glass film which will be applied subsequently. Hence, there results a downgrading in the final magnetic qualities of the steel.

In addition, such a non-uniformity in the surface also induces, during the stage of cold rolling, a non-uniformity of thickness in the sheet itself, which can lead to great fluctuations in the magnetic properties, and may be such as to downgrade the quality of the sheet steel in many cases.

Thus, we have found that to produce the conditions for electrolysis of water on the strip during the anodic treatment leads to excessively lengthy periods of treatment, and heavy over-pickling with large losses in weight; while it also leads to a surface quality of the sheet steel which is less than satisfactory.

We have also discovered that silicon electrical steels are capable of forming a sufficiently uniform and protective film on their surfaces without resorting to water electrolysis during the anodic phase. Other auxiliary unexpected advantages have emerged in relation to this unexpected and surprising fact, besides the obvious saving in time and energy. Such advantages consist in a greater ease of cold rolling of the strips which are treated by this invention, with better uniformity in the thickness of the strips; there is also the possibility of obtaining a high-quality pickling and the possibility of guaranteeing a better formation and adhesion to the substrate of the glass film which forms during annealing in the bell-furnace, subsequent to cold rolling.

It is an object of this invention to provide, by means of electrolytic treatment in neutral media, for the protection of strips of silicon electrical steel against oxidation during the stages of storage and working which occur between the electrolytic treatment itself and the coating of the coldrolled strip with annealing separators.

Another object of the present invention is to achieve an easier cold rolling and a better uniformity of thickness in the rolled steel.

A further object of the present invention is to achieve a more uniform and compact formation of the glass film during annealing in the bell-firnace, subsequent to cold rolling, and a better adhesion to the substrate of this glass film, derived from the separators used in annealing.

Another object of the present invention is to achieve a substantial saving of time and energy during the electrolytic process.

Finally, it is an object of the present invention to achieve a pickling of excellent quality with a reduction in the time of treatment and the consumption of current used on the strip.

The present invention is therefore an addition to an otherwise conventional production process for silicon electrical steel sheet, which includes the hot rolling of the steel in strips 2–4 mm thick; subjecting these strips to pickling in neutral aqueous medium in which the strip assumes alternately the functions of anode and cathode; subjecting the pickled strip to heat treatment; cold rolling the strip; coating it with annealing separators; annealing it in a bell-furnace; and subjecting it to final heat treatment.

In the framework of this procedure, the present invention provides an improvement characterized by the fact that during the anodic phase of the electrolytic neutral treatment, a difference of potential is imposed between the strip and the counter electrode, so as to impart to the steel a potential related to the standard hydrogen electrode (SHE) which is less than +1 V, and preferably less than +0.80 V. Furthermore, during this anodic phase, the density of the current which flows across the strip is initially imposed in a range between 20 and 60 A/dm$^2$. This current density is left free to drift toward lower values during the course of the anodic phase, in order to maintain the above-mentioned condition for the working potential of the steel.

The complete electrolytic treatment should preferably have a normal total duration of less than 60 seconds, and it is composed of a series of alternating cathodic and anodic steps each of these steps having a duration of not more than 20 seconds.

Finally, in a complete electrolytic treatment, during the first anodic phases, the current density initially imposed on the strip is between 40 and 60 A/dm$^2$; while during the last anodic phase, the current density initially imposed on the strip will be between 20 and 30 A/dm$^2$.

The present invention will now be described in more detail, in a non-limitative way, in relation to a series of industrial tests carried out for comparative purposes, and including tests of pickling according to the present invention (A and B); tests of pickling according to the known method described above, for example as in the Italian application identified above (C) and tests of conventional acid pickling treatment (D).

The results of these tests are recorded in the following table:

| Type of Pickling Characteristics | A | B | C | D |
|---|---|---|---|---|
| Time for appearance of rust (hours) | 1000 | 2500 | 1500 | 1 |
| Rolling load in % of rolling load of D | 85 | 90 | 100 | 100 |
| Adherence of glass film, mm of radius of bending at 180° C. | 7.5 | 5 | 10 | 25 |
| Continuity of glass film, % surface of pores on coating | 10 | 1 | 20 | 30 |
| Oscillation of the magnetic characteristics around the mean in % | ±2 | ±2 | ±4 | ±5 |
| Treatment times seconds at 60° C. | 50 | 40 | 120 | 80 |
| Losses in weight g/dm$^2$ | 0.30 | 0.28 | 1.25 | 0.40 |

The tests were run on steel strip 3 mm thick, having the following weight percent composition:

C 0.025
Si 3.10
Mn 0.29
S 0.02
P 0.005
Cu 0.12
Ni 0.07
Cr 0.03 balance essentially iron.

In this table, Treatment A consisted of a series of five cathodic-anodic alternations, each of the semi-alternations having a duration of five seconds. During each anodic phase (anodic semi-alternation), the work potential of the strip varied between +0.80 and +0.95 V, related to the SHE.

During the first alternation, the initial current density of each semi-alternation was 60 A/dm$^2$; during the second it was 50 A/dm$^2$; during the third and fourth it was 30 A/dm$^2$; and during the fifth it was 20 A/dm$^2$.

In this instance, the break-up of the treatment into a series of cathodic-anodic alternations, or cycles, had the aim of increasing the pickling effect of the process, while the reduced duration of these cycles had the aim of ensuring that at no stage during the anodic phases could any oxygen develop from the surface of the strip, which oxygen formation, as we mentioned earlier, indicates over-pickling and non-uniform thicknesses in the passivised strata. The limitation of the potential difference between strip and counter-electrode also has the aim of preventing the development of oxygen from the surface of the strip, and in this instance it represents an auxiliary safeguarding factor.

The maintenance of the density of the initial current at a high level in the first cycles and then the lowering of it in the subsequent cycles has the aim of ensuring a saving in current, while still allowing for the almost complete removal of scale during the first two or three cycles, and a sufficient protection for the strip in the later cycles.

Treatment B consisted in one cycle only, or one cathodic-anodic alternation, in which each semi-cycle had a duration of 20 seconds. The density of the initial current of each semi-cycle was 60 A/dm$^2$. The difference in potential imposed between strip and counter-electrode in the anodic semi-cycle was such as to impart to the strip a potential of approximately +1 V/SHE. In this case, the division of the treatment into only one cathodic and one anodic phase had the aim of overcoming, in the anodic cycle, the initial stabilization of the potential acquired by the strip, and the subsequent very rapid rise of potential toward distinctly higher values. The maintenance of working potential of the strip, which functions as an anode, at +1 V/SHE, has the aim of preventing the reaching of potential levels capable of bringing about the electrolysis of the water, with subsequent development of oxygen from the surface of the strip. In this way, it is possible to bring about the formation of the strip of a passivated, greyish, silicon-rich layer which is probably fayalite. This passivated layer not only offers an important protection for the strip, but is also brings about other advantages of an important kind. In fact, despite the fact that in the cold-rolling phase it becomes broken up and probably detached from the strip, the strip itself continues to be protected from oxidation for a considerable period of time, and is able to form an extremely uniform glass film, which is compact and adherent, during annealing in the bell-furnace. The reason for this is not yet entirely clear, but a plausible explanation is that on the surface of the strip after cold rolling there remain a great number of very small particles of this same greyish surface layer. These particles during the decarburizing annealing would favor, acting as growth nuclei, the formation of fayalite which in turn, reacting with the annealing separators in the bell-furnace, would form an excellent glass film.

As for the glass film itself, it is important to note here that its continuity has been measured as a percentage of the covered surface, by using as an electrode part of the surface of the coated strip in an electrolytic cell, and measuring the quantity of the current which can flow across such an electrode at a given imposed potential.

In Treatments A and B, the strip has a potential of from −1.1 to −1.3 V/SHE.

Treatment C consisted, as mentioned several time in the above-identified Italian application, in a cathodic phase followed by an anodic phase, conducted in such a way that the electrolysis of the water took place on the surface of the strip, with the development of hydrogen in the cathodic phase and oxygen in the anodic phase.

Despite the brilliant appearance of the surface of the strip, and despite the excellent surface protection thus obtained, the times of treatment, even though substantially longer than those given in the Italian application already mentioned, proved insufficient to ensure the necessary uniformity of the passivated layer. Moreover, not only did the cold rolling loads turn out to be equal to those needed for strips pickled in sulphuric acid, but the disuniformity of the passivated film had produced disuniformities of thickness in the strip. This, in its turn, had caused fluctuations in magnetic characteristics which led to marked downgrading of the steel.

In Treatments A, B and C, the bath was an aqueous solution of 1.5 M $Na_2SO_4$. The steel strip was connected to ground and the polarization thereof was induced through auxiliary electrodes facing the strip.

Treatment D was a traditional pickling in sulphuric acid, more particularly an aqueous solution of 15% $H_2SO_4$ and 3% $FeSO_4$.

In all tests, the bath temperature was 60° C.

From a consideration of the foregoing disclosure, therefore, it is evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a process for the production of silicon electrical steel sheet comprising in sequence the steps of hot rolling a strip of the steel; subjecting the strip to electrolytic pickling in a neutral aqueous medium, with the strip assuming a cathodic and anodic function; subjecting the strip thus pickled to heat treatment; cold rolling the strip; coating the strip with an annealing separator; annealing the strip; and subjecting the strip to final heat treatment; the improvement comprising, during the anodic phase of said electrolytic pickling, imposing on the strip a potential less than +1 V with respect to the standard hydrogen electrode.

2. A process according to claim 1, in which during said anodic phase, the current density across the strip is initially between 20 and 60 A/dm$^2$.

3. A process according to claim 1, in which the complete electrolytic treatment has a duration less than 60 seconds, and is composed of a plurality of cathodic-anodic cycles, each one of which has a duration of less than 20 seconds.

4. A process according to claim 3, in which in an entire electrolytic treatment during the first anodic phase, the density of initial current imposed is between 40 and 60 A/dm$^2$, while during the last anodic phase, this density is between 20 and 30 A/dm$^2$.

5. A process according to claim 1, in which said potential is less than +0.8 V/SHE.

* * * * *